US005668336A

United States Patent [19]

Miyano

[11] Patent Number: 5,668,336

[45] Date of Patent: Sep. 16, 1997

[54] MUSIC SYSTEM, TONE GENERATOR AND MUSICAL TONE-SYNTHESIZING METHOD

[75] Inventor: Yasuhisa Miyano, Hamamatsu, Japan

[73] Assignee: Yamaha Corporation, Japan

[21] Appl. No.: 659,171

[22] Filed: Jun. 5, 1996

[30] Foreign Application Priority Data

Jun. 7, 1995 [JP] Japan ..... 7-140814

[51] Int. Cl.[6] ..... G10H 7/04

[52] U.S. Cl. ..... 84/605

[58] Field of Search ..... 84/603–607

[56] References Cited

U.S. PATENT DOCUMENTS 5,321,198 6/1994 Suzuki et al. .

*Primary Examiner*—Stanley J. Witkowski

*Attorney, Agent, or Firm*—Graham & James LLP

[57] ABSTRACT

A music system has a main system and a subsystem. The subsystem has a RAM which is capable of having waveform data read therefrom and written thereinto in a parallel manner. Waveform data are sequentially read from the RAM in an order in which the waveform data have been written into the RAM. Musical tones are synthesized based on the read waveform data. The main system has an external memory device storing waveform data, and determines packets into which waveform data to be transferred from the external memory device to the RAM for generation of musical tones is to be divided, based on a writing time period required for a unit data to be written into the first memory means and a reading time period required for the unit data to be read from the RAM. Waveform data are sequentially read from the external memory device in the determined packets. The read waveform data are sequentially written into the RAM at areas thereof from which previously stored waveform data have been read.

12 Claims, 6 Drawing Sheets

MUSIC SYSTEM, TONE GENERATOR AND MUSICAL TONE-SYNTHESIZING METHOD

BACKGROUND OF THE INVENTION

1. Field of the Invention

This invention relates to a music system, a tone generator, and a musical tone-synthesizing method, which reproduce waveform data.

2. Prior Art

Conventionally, a music system is known, which reads out waveform data stored in a hard disk or a floppy disk, and generates musical tones based on the waveform data. The conventional music system is comprised of a host system formed by an ordinary personal computer or the like, which is equipped with an external memory device such as a hard disk, and a subsystem having a sound board connected to the host system via a predetermined interface. The host system operates on a program stored in a program memory to read waveform data (PCM data) to be reproduced over a long time period, from a hard disk or a floppy disk as the external memory device, and sends the read waveform data to the sound board of the subsystem.

On the other hand, the sound board once stores the wave data supplied from the host system in a RAM, reads the waveform data from the RAM to form musical tone data by means of a tone generator LSI, and converts the musical tone data to an analog signal by means of a D/A converter, which is then sounded by a sound system formed of an amplifier, a loudspeaker, etc.

In the conventional computer music system described above, however, the amount of waveform data which can be reproduced at one time by the sound board, i.e. the reproduction time period for reproducing musical tones depends upon a writing time period required for waveform data transferred from the host system to be written into the RAM of the sound board, the memory capacity of the RAM, and a reproduction time period required for reading the waveform data from the RAM and generating musical tones.

Therefore, for example, as disclosed in Japanese Laid-Open Patent Publication (Kokai) No. 5-66777 and its corresponding U.S. Pat. No. 5,321,198, a RAM is employed as a waveform memory, which has two divided memory areas to serve as a double buffer such that while one piece of waveform data is being read from the RAM for reproduction, another piece of waveform data is written into the RAM. By repeating this reading and writing operation, any long piece of waveform data can be reproduced. A music system according to these publication has an exclusive host system or subsystem which has a much shorter writing time period than a reproduction time period thereof.

Thus, the system according to U.S. Pat. No. 5,321,198, etc. having a much shorter writing time period than the reproduction time period can thus reproduce any long piece of waveform data without a limitation on the reproduction time period. On the other hand, however, if the host system is formed by a general-purpose personal computer, or if the subsystem uses a tone generator formed by a general purpose sound board, a RAM used in the sound board sometimes has a small memory capacity or a long writing time period required for waveform data to be written into the RAM, compared with a reproduction time period thereof. In such a case, waveform data cannot always be reproduced without a limitation on the reproduction time period. Thus, even if the same writing and reading method as disclosed in the above publications is employed, depending upon the construction of the music system or the capacity of the subsystem, the amount of waveform which can be reproduced at one time, i.e. the reproduction time period for reproducing musical tones is limited.

SUMMARY OF THE INVENTION

It is an object of the invention to provide a music system, a tone generator and a musical tone-synthesization method, which are capable of prolonging the maximum reproduction time period without being limited by the construction of the music system and/or the capacity of a waveform memory employed in the system.

To attain the above object, the present invention provides a music system comprising a subsystem including first memory means having a memory capacity and being capable of having waveform data read therefrom and written thereinto in a parallel manner, and musical tone-synthesizing means for sequentially reading waveform data from the first memory means in an order in which the waveform data have been written into the first memory means, and for synthesizing musical tones based on the read waveform data, and a main system including second memory means storing waveform data, the second memory means having a larger memory capacity than the memory capacity of the first memory means, packet-determining means for determining packets into which waveform data to be transferred from the second memory means to the first memory means for generation of musical tones is to be divided, based on a writing time period required for a unit data to be written into the first memory means and a reading time period required for the unit data to be read from the first memory means, and transfer means for sequentially reading waveform data from the second memory means in the packets determined by the packet-determining means, and for sequentially writing the read waveform data into the first memory means at areas thereof from which previously stored waveform data have been read.

Preferably, the music system includes writing time period-calculating means for measuring an actual writing time period over which waveform data is actually written into the first memory means, and for calculating the writing time period required for the unit data to be written into the first memory means, based on the actual writing time period and the memory capacity of the first memory means.

Also preferably, when the waveform data to be transferred from the second memory means to the first memory means for generation of musical tones is smaller in amount that the memory capacity of the first memory means, the transfer means writes the waveform data to be transferred from the second memory means to the first memory means for generation of musical tones into the first memory means at one time, without dividing the waveform data to be transferred from the second memory means to the first memory means for generation of musical tones into the packets determined by the packet-determining means.

More preferably, when the writing time period required for the unit data to be written into the first memory means is shorter than the reading time period required for the unit data to be read from the first memory means, the transfer means divides the waveform data to be transferred from the second memory means to the first memory means for generation of musical tones into the packets determined by the packet-determining means, and when the writing time period required for the unit data to be written into the first memory means is longer than the reading time period required for the unit data to be read from the first memory means, the transfer means divides the waveform data to be transferred from the second memory means to the first memory means for generation of musical tones into the packets if a required total reproduction time period of the first memory means is shorter than a reproduction time period required for reproducing the waveform data to be transferred from the second memory means to the first memory means for generation of musical tones.

To attain the above object, the present invention also provides a tone generator comprising first memory means having a memory capacity and being capable of having waveform data read therefrom and written thereinto in a parallel manner, second memory means storing waveform data, the second memory means having a larger memory capacity than the memory capacity of the first memory means, packet-determining means for determining packets into which waveform data to be transferred from the second memory means to the first memory means for generation of musical tones is to be divided, based on a writing time period required for a unit data to be written into the first memory means and a reading time period required for the unit data to be read from the first memory means, transfer means for sequentially reading waveform data from the second memory means in the packets determined by the packet-determining means, and for sequentially writing the read waveform data into the first memory means at areas thereof from which previously stored waveform data have been read, and musical tone-synthesizing means for sequentially reading waveform data from the first memory means in an order in which the waveform data have been written into the first memory means, and for synthesizing musical tones based on the read waveform data.

To attain the above object, the present invention further provides a method of synthesizing musical tones, which uses a main system including second memory means storing waveform data, which is characterized by an improvement wherein the method uses a subsystem including first memory means having a memory capacity and being capable of having waveform data read therefrom and written thereinto in a parallel manner, the second memory means having a larger memory capacity than the memory capacity of the first memory means, and musical tone-synthesizing means for sequentially reading waveform data from the first memory means in an order in which the waveform data have been written into the first memory means, and for synthesizing musical tones based on the read waveform data, and the method comprises a first step of determining packets into which waveform data to be transferred from the second memory means to the first memory means for generation of musical tones is to be divided, based on a writing time period required for a unit data to be written into the first memory means and a reading time period required for the unit data to be read from the first memory means, and a second step of sequentially reading waveform data from the second memory means in the packets determined by the first step, and sequentially writing the read waveform data into the first memory means at areas thereof from which previously stored waveform data have been read.

The above and other objects, features, and advantages of the invention will be more apparent from the following detailed description taken in conjunction with the accompanying drawings.

DETAILED DESCRIPTION

The invention will now be described in detail with reference to the drawings showing an embodiment thereof.

Figure 1:
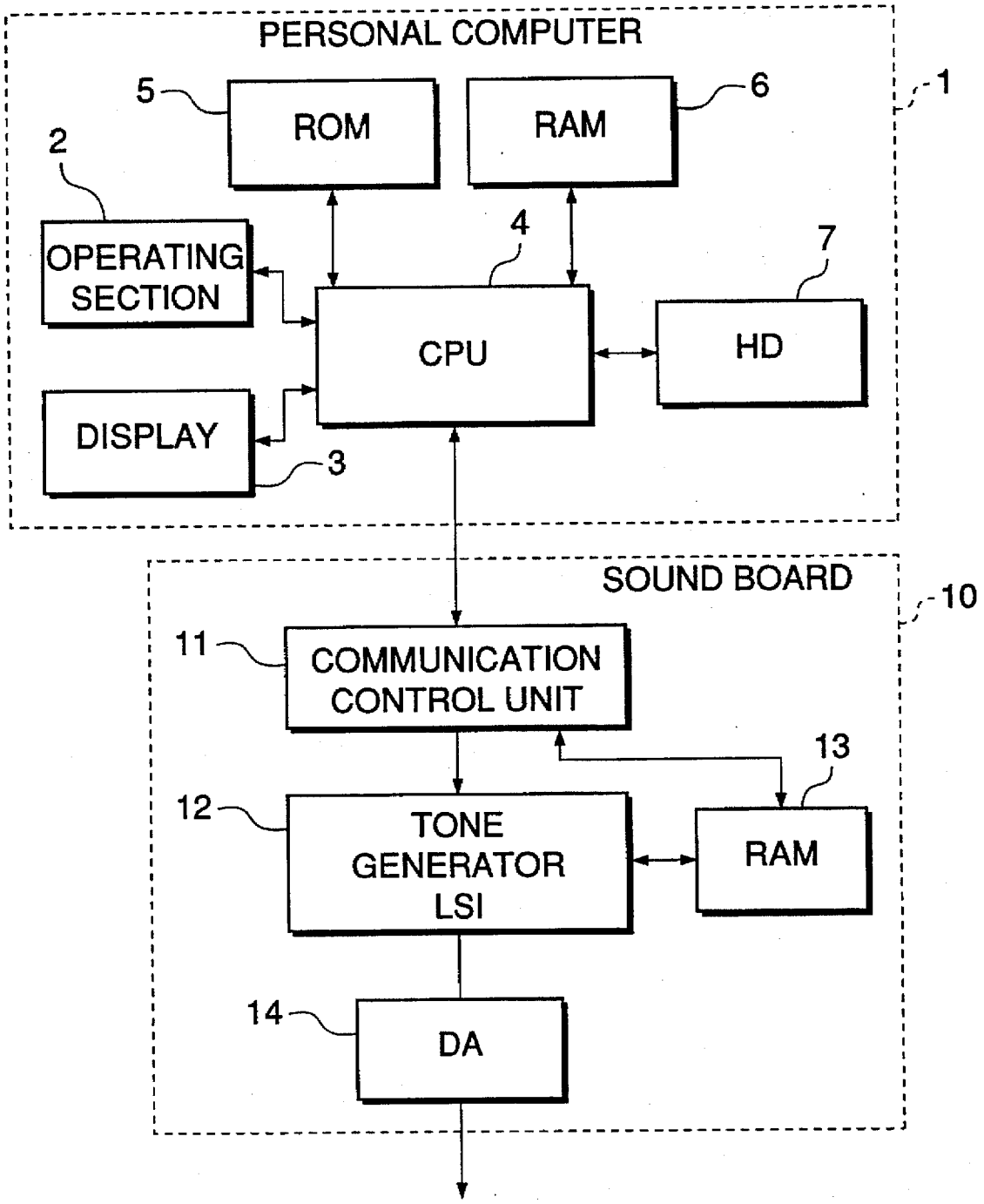
FIG. 1 is a block diagram schematically showing the arrangement of a computer music system as a music system according to an embodiment of the invention.

Referring first to FIG. 1, there is schematically illustrated the whole arrangement of a music system according to an embodiment of the invention. The music system according to the embodiment is comprised of a host computer 1, and a sound board 10 externally connected to the host computer 1. As shown in the figure, the host computer 1 is comprised of an operating section 2, a display 3, a CPU 4, a ROM 5, a RAM 6, and a hard disk drive (hereinafter referred to as "hard disk") 7. The operating section 2 is comprised of a keyboard for compiling performance data, inputting data, and instructing operations, and panel switches for selecting operating modes of performance, tone colors of musical tones, etc. The display 3 displays operating states and various kinds of information under the control of the CPU 4.

The CPU 4 operates on a program stored in the ROM 5 to read waveform data (e.g. PCM data) WD stored in the hard disk 7 and sends the read data in predetermined packets to the sound board 10. The RAM 6 is used as a work area for the CPU 4. The hard disk 7 stores waveform data WD. An external memory device such as a floppy disk and a CD-ROM may be used in place of or together with the hard disk 7.

The sound board 10 is comprised of a communication control unit 11, a tone generator LSI 12, a RAM 13, and a D/A converter 14. The communication control unit 11 is disposed to receive waveform data WD and various kinds of data for generation of musical tones from the host computer 1, and temporarily stores the received waveform data WD in the RAM 13 while delivering the various kinds of data to the tone generator LSI 12. The RAM 13 is formed by a semiconductor memory having a memory capacity of X bytes (e.g. 1 Mbytes) and constructed such that writing waveform data WD into the RAM 13 and reading the same data from the RAM 13 can be simultaneously carried out in a parallel manner.

The tone generator LSI 12 regards the RAM 13 as a waveform memory and accesses the same to sequentially read waveform data WD therefrom to thereby prepare musical tone data, which is supplied to the D/A converter 14. The D/A converter 14 converts the musical tone data to an analog signal which is supplied to a sound system, not shown. The sound system is comprised of an amplifier, a loudspeaker, etc., and generates musical sounds based on the analog or musical tone signal by the loudspeaker. The sound system may be provided within the sound board 10 or externally connected thereto.

Figure 2:
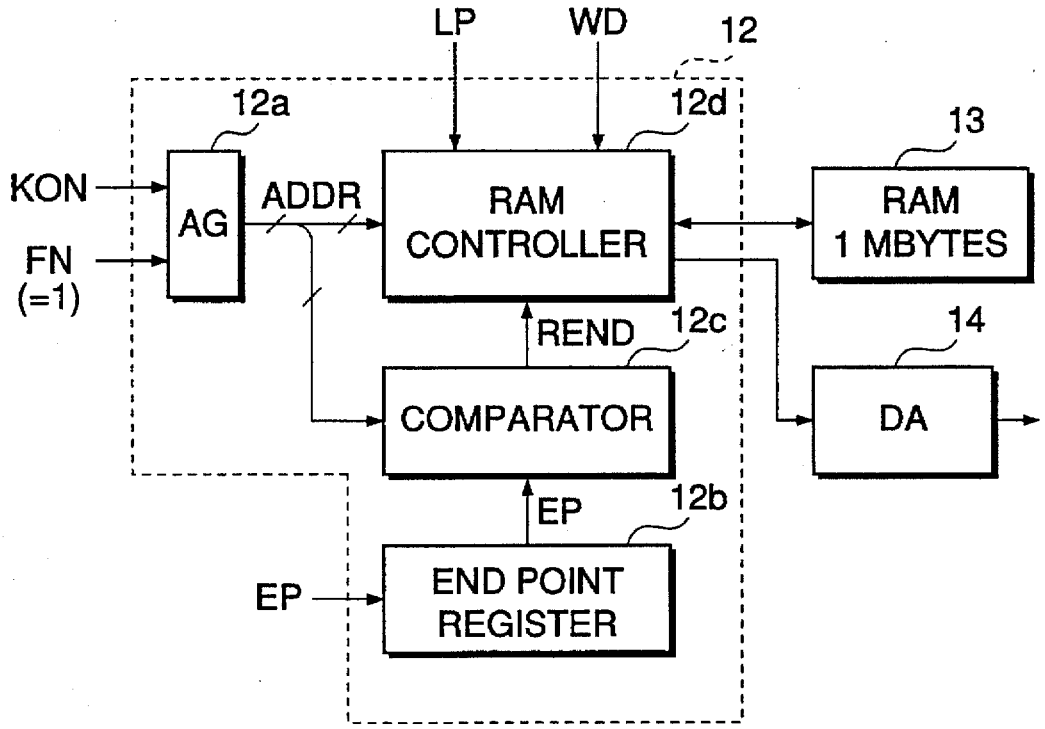
FIG. 2 is a block diagram schematically showing the arrangement of a sound system incorporated in the embodiment of FIG. 1.

FIG. 2 shows details of the arrangement of the sound board 10. In the figure, elements and parts corresponding to those in FIG. 1 are designated by identical reference numerals, description of which is omitted. As shown in FIG. 2, the tone generator LSI 12 is comprised of an address generator 12*a*, an end point register 12*b*, a comparator 12*c*, and a RAM controller 12*d*. The address generator 12*a* generates a read address ADDR for accessing the RAM 13, based on an F number FN when it is supplied with a key-on signal KON from the host computer 1 via the communication control unit 11, and delivers the same to the comparator 12*c* and the RAM controller 12*d*. The F number FN is set to a value "1" when waveform data WD is to be reproduced with the same pitch as one with which it was written into the RAM 13. If waveform data is to be reproduced with a different pitch from one with which it was written, the F number is set to a value other than "1".

The end point register 12*b* stores data indicative of an end point EP which indicates an end address for reading waveform data WD supplied from the host computer 1 via the communication control unit 11 and delivers the same to the comparator 12*c*. The comparator 12*c* compares the read address ADDR with the end point EP, and delivers a reading end signal REND to the RAM controller 12*d* when the read address ADDR reaches the end point EP. The RAM controller 12*d* writes waveform data WD delivered in packets from the host computer 1 via the communication control unit 11 into the RAM 13, and accesses the RAM 13 according to the read address ADDR from the address generator 12*a* to read waveform data WD therefrom and delivers the same to the D/A converter 14. If the reading end signal REND is delivered to the RAM controller 12*d* during the above operation, the RAM controller 12*d* stops reading the waveform data WD from the RAM 13 to terminate generation of musical tones. Further, the RAM controller 12*d* also operates in response to data indicative of a loop point LP which instructs repeated reproduction, delivered from the host computer 1 via the communication control unit 11, to repeatedly reproduce waveform data WD stored in and read from the RAM 13, according to the loop point LP. The data indicative of the loop point LP can be delivered to the RAM controller 12*d* when the amount of the waveform data WD stored in the RAM 13 to be reproduced is smaller than the memory capacity of the RAM 13 (1 Mbytes in the present embodiment).

Next, description will be made of how writing waveform data WD into and reading the same from the RAM 13 of the sound board 10. In the present embodiment, the host computer 1 first transfers waveform data WD in an amount corresponding to the memory capacity X of the RAM 13 to the sound board 10. In the sound board 10, the waveform data WD received from the host computer 1 is once stored in the RAM 13 and then sequentially read therefrom by the tone generator LSI 12, starting with a start point (start address) SP of the data to thereby synthesize musical tone data. On this occasion, a next piece of waveform data WD is sequentially stored in the RAM 13 at an area thereof from which the preceding piece of waveform data WD has been read, by the tone generator LSI 12. That is, at a time point reading of a first piece of waveform data WD from the RAM 13 has been completed by the tone generator LSI 12, a second or next piece of waveform data WD has already been stored in the RAM 13. Immediately after completion of synthesization of musical tones based on the first piece of waveform data WD, the tone generator LSI 12 synthesizes musical tones based on the second or next piece of waveform data WD. While the second piece of waveform data is being read from the RAM 13 by the tone generator LSI 12, the next piece of waveform data WD is written into the RAM 13 at the area from which the second piece of waveform data has been read by the tone generator LSI 12. In this way, the tone generator LSI 12 sequentially reads from the RAM 13 consecutive pieces of waveform data WD sequentially written into the RAM 13 to synthesize musical tones based on the read waveform data WD. As a result, waveform data can be continuously reproduced to continuously generate musical tones without any limitation on the reproduction time period.

To carry out continuous reproduction of waveform data WD without a limitation on the reproduction time period, however, the following condition has to be satisfied: That is, assuming that the data sampling frequency is designated by $f_0$ and the writing time period required for one sample of data to be written into the RAM 13 by $t_0$, a condition of $t_0<1/f_0$ has to be satisfied. In other words, it is required that the writing time period $t_0$ required for one sample of data to be written into the RAM 13 should be sufficiently smaller or shorter than a reproduction time period $1/f_0$ required for one sample of data to be read from the RAM 13 and reproduced. The reproduction time period for reproducing one sample of data also depends upon the value of the F number. That is, it is smaller or shorter as the F number is larger, while it is larger or longer as the F number is smaller. The music system according to the present embodiment can realize continuous reproduction without a limitation on the reproduction time period (hereinafter referred to as "unlimited reproduction") when the above condition is satisfied. When the above condition is not satisfied, continuous reproduction with a limitation on the reproduction time period (hereinafter referred to as "limited reproduction") can be realized. In carrying out unlimited reproduction under the condition of $t_0<1/f_0$, rewriting of musical tone data not yet read from the RAM 13 must be prevented by means of the double buffer method disclosed by U. S. Pat. No. 5,321,198, etc. referred to hereinbefore, or a weighting method. Further, even if limited reproduction is carried out, the reproduction time period can be sufficiently prolonged to a time period longer than that of the prior art referred to hereinbefore, though it depends upon the memory capacity X of the RAM 13, the writing time period $t_0$ of the RAM 13, etc. Generally, when an exclusive computer and an exclusive sound board are originally developed as the host computer 1 and the sound board 10 and assembled into a music system, they will be designed so as to satisfy the condition of $t_0<1/f_0$, to thereby enable carrying out unlimited reproduction. If general-purpose parts (personal computer, software, a tone generator chip, RAM, etc.) are employed and assembled into a music system, however, the above condition of $t_0<1/f_0$ cannot always be satisfied. That is, a condition of $t_0 \geqq 1/f_0$ can hold. Even in such a case, according to the invention, the maximum reproduction time period can be prolonged without being limited by the memory capacity X of the RAM 13, as stated above. Thus, the invention aims to prolong the maximum reproduction time period even if the music system is composed of general-purpose component parts.

Figures 3A, 3B, 3C:
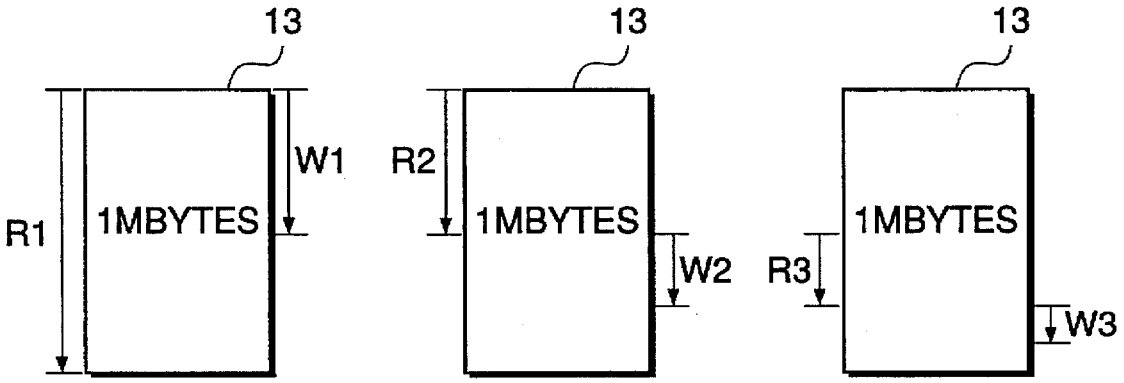
FIGS. 3A, 3B and 3C are conceptual representations useful in explaining operations of writing into a RAM of a sound board of the embodiment and reading therefrom.

Next, an example of operations of writing waveform data WD into the RAM 13 and reading the same therefrom will be described with reference to FIGS. FIG. 3A, FIG. 3B and FIG. 3C. In the illustrated example, it is assumed that the RAM 13 has a memory capacity of 1 Mbytes. In the figures, symbol Ri (i=1, 2, 3. . . . ) designates a reproduction time period (or reading time), and Wi (i=1, 2, 3. . . . ) a writing time period. Let it now be assumed that the writing time period $t_0$ required for one sample of data to be written into the RAM 13 is 40 nsec, and the reproduction time period required for one sample of data to be reproduced is approximately 20 nsec (=1/44.1 kHz). Then, a time period of 20 sec is required to elapse after a first piece of waveform data WD is written into the RAM 13 and before the tone generator LSI 12 reproduces the waveform data WD from the start point (start address) SP to the end point (end address) EP (refer to R1 in FIG. 3A). If writing of a second or next piece of waveform data WD into the RAM 13 is started with the start point SP simultaneously with the above reproducing operation, data of 500 kbytes can be written into the RAM 13 within the above time period of 20 sec (W1 in FIG. 3A). Then, if the reading point by the tone generator LSI 12 is returned to the start point SP and reproduction of the data of 500 kbytes is started, a time period of 10 sec is required to elapse before the reproduction is completed (R2 in FIG. 3B). Further, also within the above time period of 10 sec, data of 250 kbytes as a third piece of waveform data can be written into the RAM 13 starting with the start point SP (W2 in FIG. 3B). Then, similarly, during a time period for which the newly written data is reproduced (R3 in FIG. 3C), the next piece of data is written into the RAM 13 (W3 in FIG. 3C). The total reproduction time period required for the above simultaneous reading and writing operations is 20 sec+10 sec+5 sec+2. 5 sec+. . .

The individual reproduction time periods can be expressed as follows:

$T(R1)=C/f_0$ $T(R2)=T(R1)/(t_0 \times f^0)$ $T(R3)=T(R2)/(t_0 \times f^0)$

In the above formulas, T(Ri) represents an ith reproduction time period (reading time period), and C the memory capacity of the RAM.

The total reproduction time period TMAX is expressed as follows:

$$TMAX=T(R1)+T(R2)+T(R3)+\ldots$$

Therefore, in the above given example, the total reproduction time period TMAX is prolonged by the second time period et seq., i.e., the reproduction time periods T(R2), T(R3), . . . In the above given example, the maximum reproduction time period, which is conventionally 20 sec, is prolonged to approximately 30 sec. In an actual system, the difference between $t_0$ and $1/f_0$ can often be very small, and in such a case nearly unlimited reproduction is possible. Particularly, if the condition of $t_0<1/f_0$ is satisfied, unlimited reproduction can be realized, as stated above.

The operation of the present embodiment will now be described with reference to flowcharts of FIGS. 4 through 7.

Figure 4:
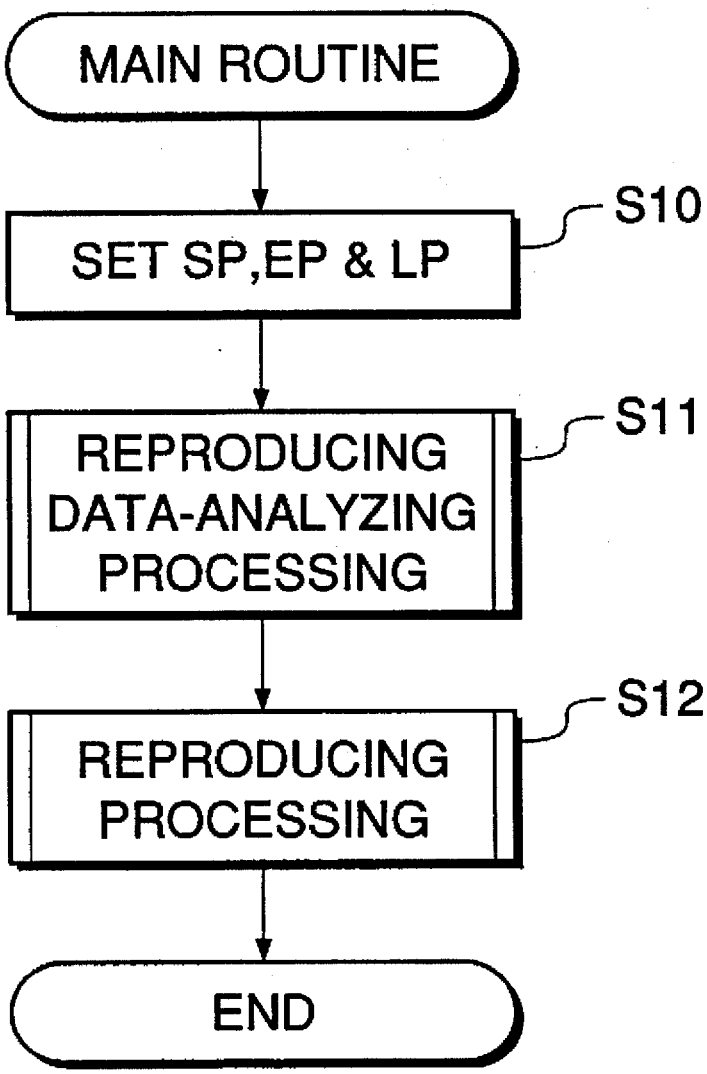
FIG. 4 is a flowchart showing a main routine executed by a host computer of the embodiment.

FIG. 4 shows a main routine executed by the host computer 1. First, at a step S10, the host computer 1 sets a start point (start address) SP, an end point (end address) EP and a loop point LP for waveform data WD stored in the hard disk 7, which is to be reproduced. The loop point LP can be set only when waveform data WD which has a capacity equal to or less than the memory capacity of the RAM 13 (1 Mbytes) is to be reproduced. Then, at a step 11, reproducing data-analyzing processing is executed, in which calculation of the writing time period $t_0$ and the total reproduction time period TMAX and determination of packets in which the waveform data WD is to be divided and transferred to the sound board 10 are made based on the start point SP and end point EP set at the step S10. Details of the reproducing data-analyzing processing will be described hereinafter. Then, at a step S12, reproduction processing is executed, in which the waveform data WD is read from the hard disk 7 according to the writing time period $t_0$ and packets calculated and determined at the step S11 and the read data is transferred to the sound board 10. Details of the reproduction processing will also be described hereinafter. The sound board 10 stores the waveform data WD received from the host computer 1 in the RAM 13, sequentially reads the waveform data WD from the RAM 13, synthesizes musical tone data based on the read data and converts the same to an analog signal to be sounded by the sound system, not shown.

Figure 5:
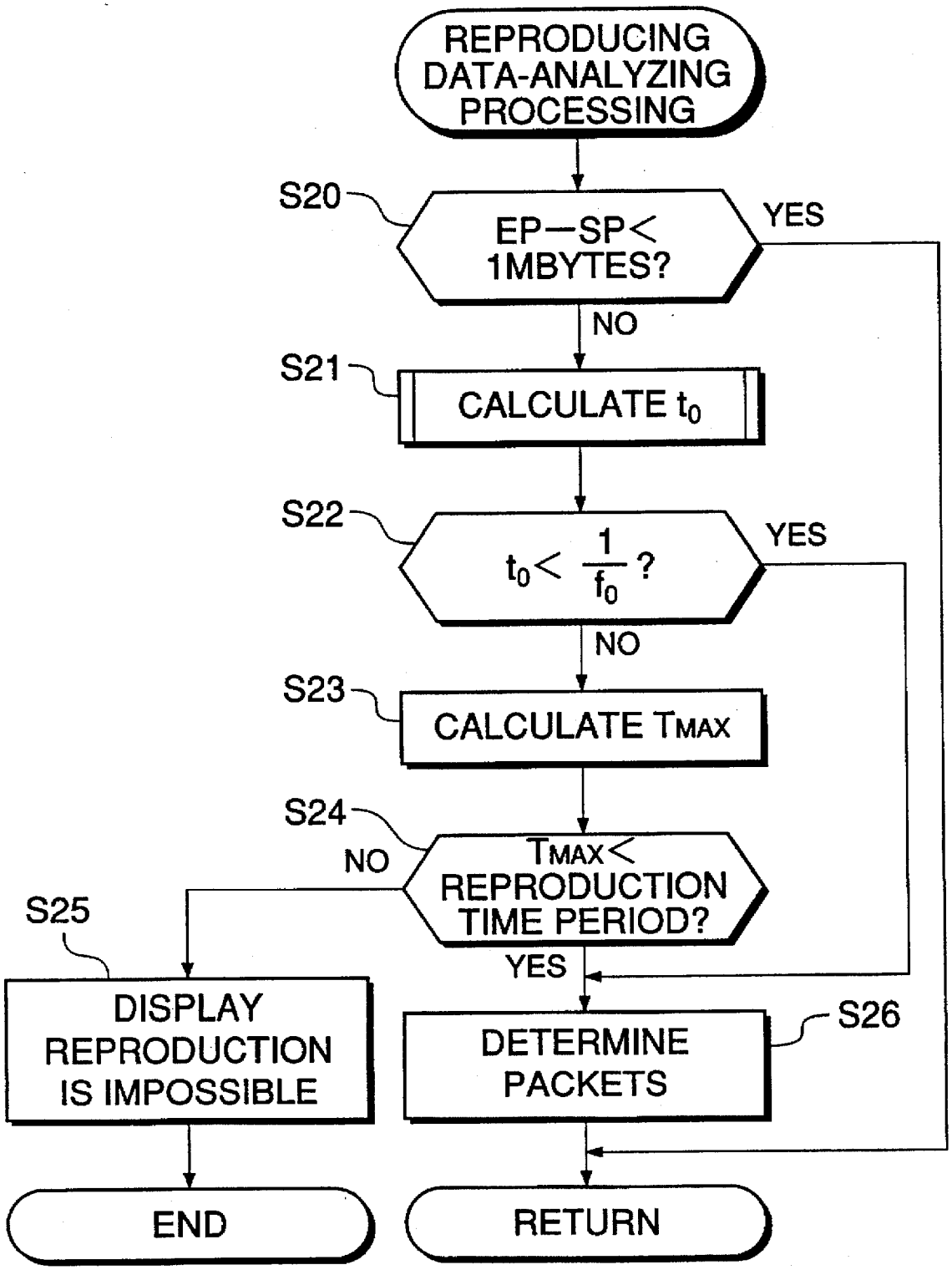
FIG. 5 is a flowchart showing a routine for carrying out reproducing data-analyzing processing executed by the host computer.

Details of the reproducing data-analyzing processing will be described with reference to a flowchart of FIG. 5 showing a routine for carrying out the reproducing data-analyzing processing. The host computer 1 carries out the present processing after setting the start point SP, the end point EP and the loop point LP at the step S10 of the FIG. 4 main routine. First, at a step S20, it is determined whether or not a difference between the end point EP and the start point SP is smaller than the memory capacity (1 Mbytes) of the RAM 13, that is, whether or not the waveform data WD to be reproduced can be written into the RAM 13 at one time. If the difference is smaller than the memory capacity of 1 Mbytes, the answer to the question of the step S20 is affirmative (YES), and then the present routine is immediately terminated, and the program returns to the above described main routine to execute the step S12. In this case, since the waveform data WD to be reproduced can be written into the RAM 13 at one time, no parallel operations of writing and reading data into and from the RAM are not required, that is, the calculation of the writing time period $t_0$ and the total reproduction time period TMAX and the determination of packets need not be carried out, and therefore the present routine is immediately terminated.

Figure 6:
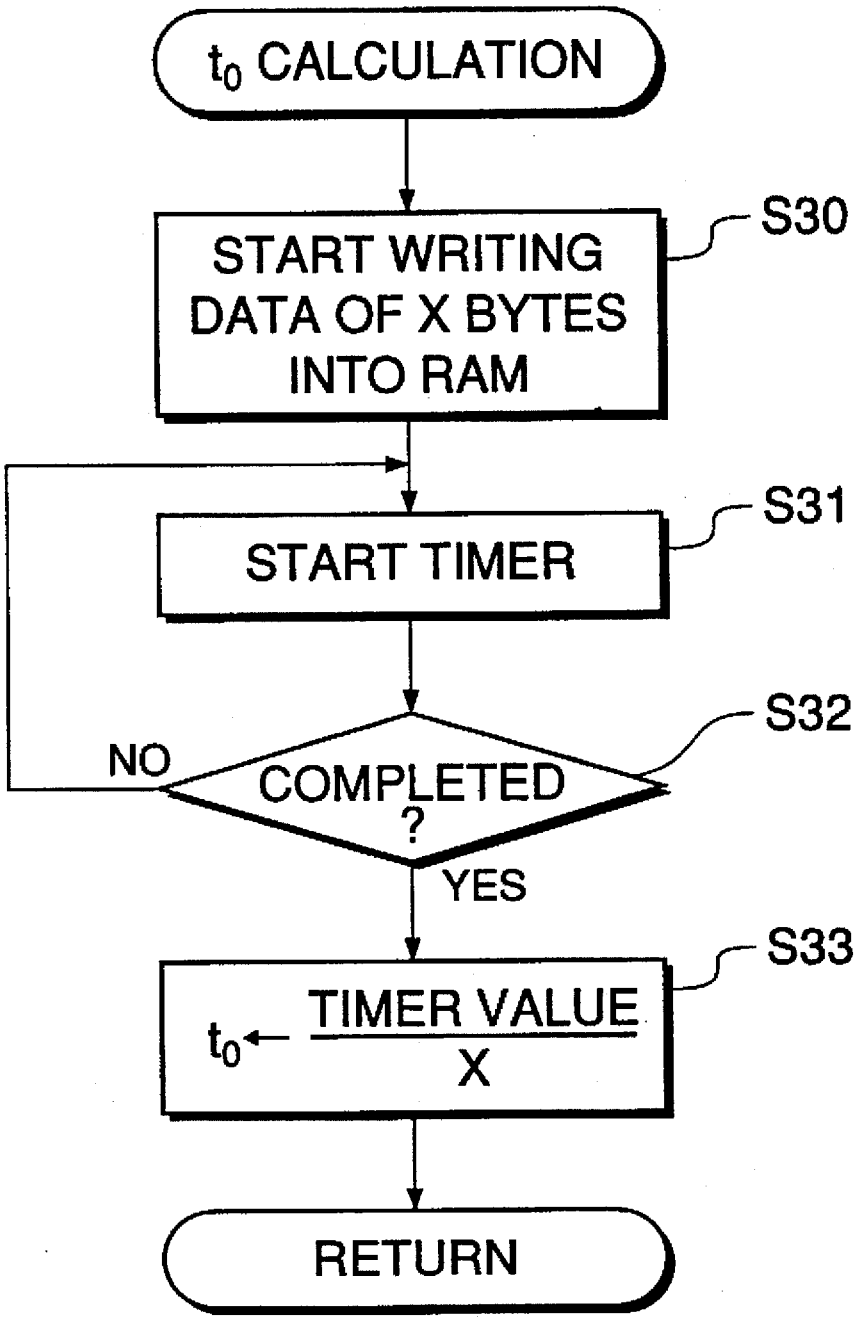
FIG. 6 is a flowchart showing a routine for calculating a writing time period $t_0$, which is executed by the host computer.

On the other hand, if the waveform data WD to be reproduced is larger than the memory capacity of 1 Mbytes, the answer to the question of the step S20 is negative (NO), and then the program proceeds to a step S21, wherein the writing time period $t_0$ required for writing one sample of data into the RAM 13 is calculated according to a routine shown in FIG. 6. In the FIG. 6 routine, first, at a step S30, suitable data is transferred to the sound board 10 to start writing the data into the RAM 13 with a memory capacity X (1 Mbytes in the present embodiment). Then, at a step S31, a predetermined timer is started, and at a step S32, it is determined whether or not the writing of the data into the RAM 13 has been completed. This determination is made based on a signal sent from the sound board 10. The step S31 is repeatedly executed until the writing is completed. When the writing is completed, the answer to the question of the step S31 becomes affirmative (YES), and then the program proceeds to a step S33. At the step S33, the count value of the timer is divided by the memory capacity X of the RAM 13 to obtain the writing time period $t_0$, followed by terminating the present routine. Then, the program proceeds to the reproducing data-analyzing processing of FIG. 5 to execute a step S22.

At the step S22, it is determined whether or not the writing time period $t_0$ calculated as above is shorter than the reproduction time period $1/f_0$, that is, whether limited reproduction or unlimited reproduction can be carried out. If the writing time period $t_0$ is longer than the reproduction time period $1/f_0$, that is, the aforementioned condition of $t_0<1/f_0$ is not satisfied and accordingly only limited reproduction can be carried out, the answer to the question of the step S22 is negative (NO), and then the program proceeds to a step S23, wherein the total reproduction time period TMAX is calculated. Then, at a step S24 it is determined whether or not the calculated total reproduction time period TMAX is shorter than a reproduction time period required for the waveform data WD to be reproduced. If the former is longer than the latter, it is impossible to reproduce the waveform data WD, and then the program proceeds to a step S25 to cause the display 3 to display a message to the effect that the reproduction is impossible to carry out, and reproduction of musical tones is immediately terminated.

On the other hand, if the total reproduction time period TMAX is shorter than the reproduction time period of the waveform data WD, the answer to the question of the step S24 is affirmative (YES), and then the program proceeds to a step S26, wherein the waveform data WD to be reproduced is divided into packets (e.g. X bytes, X/2 bytes, X/4 bytes . . . . : X=memory capacity of the RAM 13) in which the waveform data WD is to be transferred, according to the writing time period $t_0$, the reproduction time period $1/f_0$, and the total reproduction time period TMAX. Then, the present routine is terminated, and the program returns to the main routine of FIG. 4 to execute the step S12.

If it is determined at the step S22 that the writing time period $t_0$ is shorter than the reproduction time period $1/f_0$, that is, unlimited reproduction can be carried out, the program jumps to the step S26. In the unlimited reproduction, since the writing time period for writing data into the RAM 13 is shorter than the reproduction time period for reproducing the data, the packets are set to a value equal to the memory capacity X (1 Mbytes) of the RAM 13.

Figure 7:
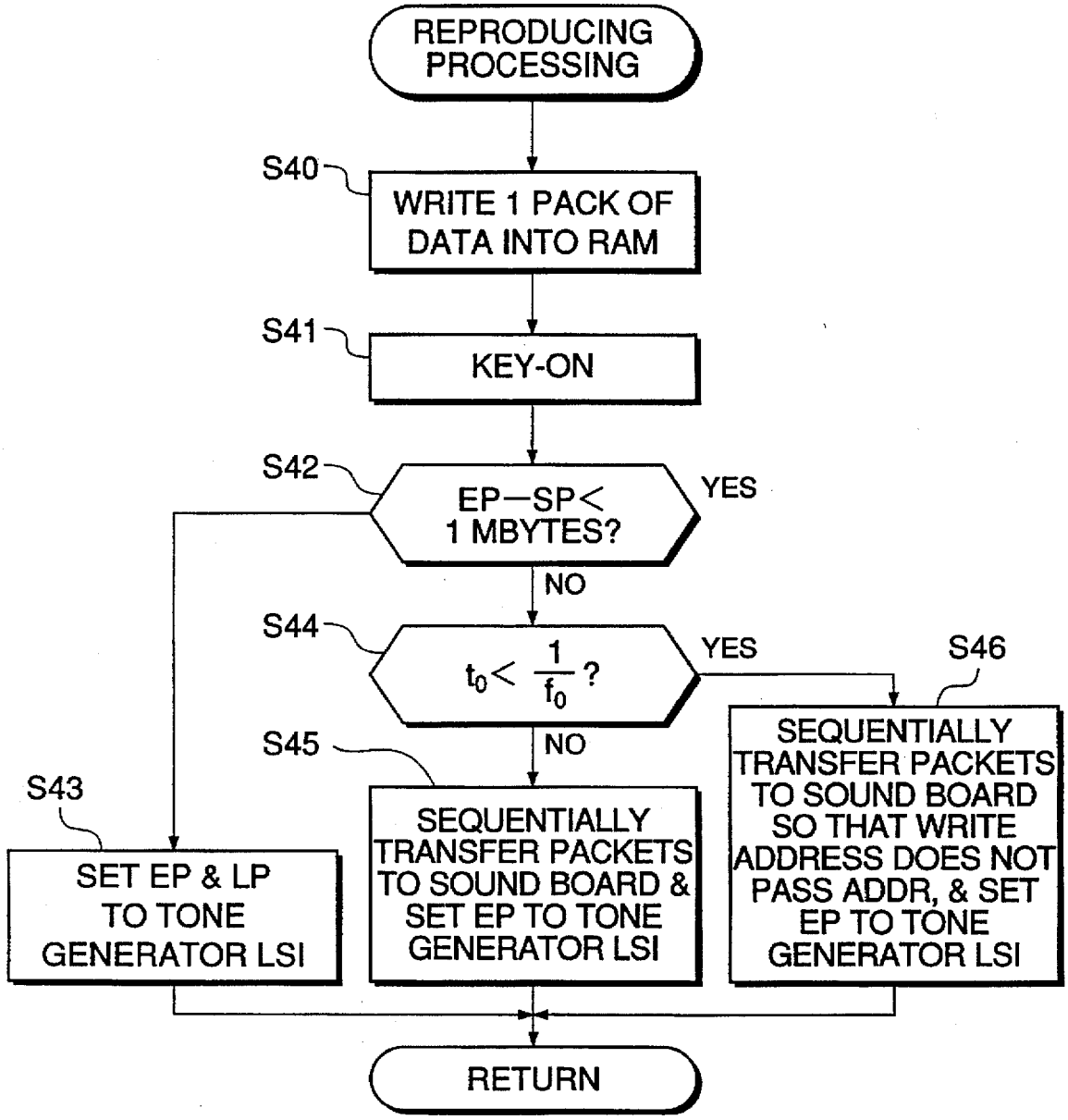
FIG. 7 is a flowchart showing a routine for carrying out reproduction of waveform data, which is executed by the sound board.

Next, details of the reproduction processing will be described with reference to FIG. 7 showing a routine for carrying out the reproduction processing. This processing is carried out after termination of the above described reproducing data-analyzing processing. First, at a step S40, according to the packets determined by the reproducing data-analyzing processing, a first packet of the waveform data WD is transferred to the sound board 10. Since the memory capacity of the RAM 13 is 1 Mbytes, if the amount of the waveform data WD is larger than 1 Mbytes, an amount of 1 Mbytes of data is transferred as the first packet, whereas if the amount is smaller than 1 Mbytes, the total waveform data WD is transferred as the first packet. In the sound board 10, the waveform data WD transferred from the host computer 10 is stored in the RAM 13.

Then, at a step S41, the host computer 1 sends a key-on signal KON to the sound board 10 to instruct starting reproduction. In the sound board 10, the address generator **12*a* operates in response to the key-on signal KON to generate a read address ADDRESS and supplies the same to the RAM controller 12*d*. The RAM controller 12*d* reads the waveform data WD from the RAM 13 according to the read address ADDR, which is converted to an analog signal by the D/A converter 14** to be sounded by the sound system.

In parallel with the above described reproduction by the sound board 10, the host computer 1 determines whether or not the difference between the end point EP and the start point SP is smaller than 1 Mbytes, at a step S42. As mentioned before, this determines whether or not the waveform data WD to be reproduced can be transferred to the sound board 10 at one time. If it is smaller than 1 Mbytes, that is, the waveform data WD to be reproduced can be transferred at one time, the answer to the question of the step S42 is affirmative (YES), and then the program proceeds to a step S43, wherein the end point EP and also the loop point LP if required are transferred to the sound board 10 and set to the tone generator LSI 12, followed by terminating the present routine. In the sound board 10, the end point EP is stored in the end point register **12*b*. When the read address ADDR from the address generator 12*a* reaches the end point EP during reproduction, i.e. during generation of musical tones based on the waveform data WD read from the RAM 13, the generation of musical tones is stopped. On the other hand, if the loop point LP is transferred to the sound board 10, after the read address ADDR reaches the end point EP, generation of musical tones based on the waveform data WD read from the RAM 13** is repeatedly executed, in response to the loop point LP.

If the difference between the end point EP and the start point SP is larger than 1 Mbytes, the answer to the question of the step S42 is negative (NO), and then the program proceeds to a step S44, wherein it is determined whether or not the writing time period $t_0$ for writing data into the RAM 13 is shorter than the reproduction time period $1/f_0$, that is, whether the condition of $t_0<1/f_0$ is satisfied. If $t_0$ exceeds $1/f_0$, that is, limited reproduction should be carried out, the answer to the question of the step S44 is negative (NO), and then the program proceeds to a step S45, wherein the determined packets of waveform data WD are sequentially transferred at predetermined timing to the sound board 10. Further, when the last packet of data has been transferred, the end point EP is transferred to the sound board 10 and set to the tone generator LSI 12, followed by terminating the present routine. In the sound board 10, the packets of waveform data sequentially written into the RAM 13 are sequentially read therefrom and then converted to an analog signal by the D/A converter 14, to be sounded by the sound system. When the end point EP is received, it is stored in the end point register **12*b*. When the read address ADDR from the address generator 12*a* reaches the end point EP while the last packet of waveform data WD is being read from the RAM 13, the reading end signal REND is generated from the comparator 12*c***, whereby the generation of musical tones is terminated.

On the other hand, if the writing time period $t_0$ is shorter than the reproduction time period $1/f_0$, that is, unlimited reproduction can be carried out, the answer to the question of the step S44 is affirmative (YES), and then the program proceeds to a step S46, wherein the packets of waveform data WD are sequentially transferred to the sound board 10 in such a manner that the write address at which each packet of data is written into the RAM 13 by the RAM controller **12*d* does not pass the read address ADDR at which the previous packet is read from the RAM 13 by the RAM controller 12*d*, followed by terminating the present routine. Further, when the last packet of data has been transferred, the end point EP is transferred to the sound board 10 and set to the tone generator LSI 12, followed by terminating the present routine. In the sound board 10, the packets of waveform data WD sequentially written into the RAM 13 are sequentially read therefrom, and the read waveform data are converted to an analog signal by the D/A converter 14 to be sounded by the sound system. When the end point EP is received, it is stored in the end point register 12*b*. When the read address ADDR from the address generator 12*a* reaches the end point EP while the last packet of waveform data WD is being read from the RAM 13, the reading end signal REND is generated from the comparator 12*c*** to thereby terminate the generation of musical tones.

As described above, according to the present embodiment, waveform data WD to be reproduced is divided into packets according to the capacity of the sound board 10 forming the music system, i.e. the memory capacity of the RAM 13, the writing time period $t_0$ and the reproduction time period $1/f_0$, and the waveform data WD is transferred in the packets to the sound board 10. As a result, a large block of waveform data can be continuously reproduced over a long time period, irrespective of the memory capacity of the RAM 13.

What is claimed is:

1. A music system comprising:

a subsystem including first memory means having a memory capacity and being capable of having waveform data read therefrom and written thereinto in a parallel manner, and musical tone-synthesizing means for sequentially reading waveform data from said first memory means in an order in which said waveform data have been written into said first memory means, and for synthesizing musical tones based on said read waveform data; and a main system including second memory means storing waveform data, said second memory means having a larger memory capacity than said memory capacity of said first memory means, packet-determining means for determining packets into which waveform data to be transferred from said second memory means to said first memory means for generation of musical tones is to be divided, based on a writing time period required for a unit data to be written into said first memory means and a reading time period required for said unit data to be read from said first memory means, and transfer means for sequentially reading waveform data from said second memory means in said packets determined by said packet-determining means, and for sequentially writing the read waveform data into said first memory means at areas thereof from which previously stored waveform data have been read.

2. A music system as claimed in claim 1, including writing time period-calculating means for measuring an actual writing time period over which waveform data is actually written into said first memory means, and for calculating said writing time period required for said unit data to be written into said first memory means, based on said actual writing time period and said memory capacity of said first memory means.

3. A music system as claimed in claim 1, wherein when said waveform data to be transferred from said second memory means to said first memory means for generation of musical tones is smaller in amount that said memory capacity of said first memory means, said transfer means writes said waveform data to be transferred from said second memory means to said first memory means for generation of musical tones into said first memory means at one time, without dividing said waveform data to be transferred from said second memory means to said first memory means for generation of musical tones into said packets determined by said packet-determining means.

4. A music system as claimed in claim 3, wherein when said writing time period required for said unit data to be written into said first memory means is shorter than said reading time period required for said unit data to be read from said first memory means, said transfer means divides said waveform data to be transferred from said second memory means to said first memory means for generation of musical tones into said packets determined by said packet-determining means, and when said writing time period required for said unit data to be written into said first memory means is longer than said reading time period required for said unit data to be read from said first memory means, said transfer means divides said waveform data to be transferred from said second memory means to said first memory means for generation of musical tones into said packets if a required total reproduction time period of said first memory means is shorter than a reproduction time period required for reproducing said waveform data to be transferred from said second memory means to said first memory means for generation of musical tones.

5. A tone generator comprising:

first memory means having a memory capacity and being capable of having waveform data read therefrom and written thereinto in a parallel manner;

second memory means storing waveform data, said second memory means having a larger memory capacity than said memory capacity of said first memory means;

packet-determining means for determining packets into which waveform data to be transferred from said second memory means to said first memory means for generation of musical tones is to be divided, based on a writing time period required for a unit data to be written into said first memory means and a reading time period required for said unit data to be read from said first memory means;

transfer means for sequentially reading waveform data from said second memory means in said packets determined by said packet-determining means, and for sequentially writing the read waveform data into said first memory means at areas thereof from which previously stored waveform data have been read; and musical tone-synthesizing means for sequentially reading waveform data from said first memory means in an order in which said waveform data have been written into said first memory means, and for synthesizing musical tones based on the read waveform data.

6. A tone generator as claimed in claim 5, including writing time period-calculating means for measuring an actual writing time period over which waveform data is actually written into said first memory means, and for calculating said writing time period required for said unit data to be written into said first memory means, based on said actual writing time period and said memory capacity of said first memory means.

7. A tone generator as claimed in claim 5, wherein when said waveform data to be transferred from said second memory means to said first memory means for generation of musical tones is smaller in amount that said memory capacity of said first memory means, said transfer means writes said waveform data to be transferred from said second memory means to said first memory means for generation of musical tones into said first memory means at one time, without dividing said waveform data to be transferred from said second memory means to said first memory means for generation of musical tones into said packets determined by said packet-determining means.

8. A tone generator as claimed in claim 7, wherein when said writing time period required for said unit data to be written into said first memory means is shorter than said reading time period required for said unit data to be read from said first memory means, said transfer means divides said waveform data to be transferred from said second memory means to said first memory means for generation of musical tones into said packets determined by said packet-determining means, and when said writing time period required for said unit data to be written into said first memory means is longer than said reading time period required for said unit data to be read from said first memory means, said transfer means divides said waveform data to be transferred from said second memory means to said first memory means for generation of musical tones into said packets if a required total reproduction time period of said first memory means is shorter than a reproduction time period required for reproducing said waveform data to be transferred from said second memory means to said first memory means for generation of musical tones.

9. In a method of synthesizing musical tones, which uses a main system including second memory means storing waveform data, the improvement wherein:

said method uses a subsystem including first memory means having a memory capacity and being capable of having waveform data read therefrom and written thereinto in a parallel manner, said second memory means having a larger memory capacity than said memory capacity of said first memory means, and musical tone-synthesizing means for sequentially reading waveform data from said first memory means in an order in which said waveform data have been written into said first memory means, and for synthesizing musical tones based on the read waveform data; and said method comprises:

a first step of determining packets into which waveform data to be transferred from said second memory means to said first memory means for generation of musical tones is to be divided, based on a writing time period required for a unit data to be written into said first memory means and a reading time period required for said unit data to be read from said first memory means; and a second step of sequentially reading waveform data from said second memory means in said packets determined by said first step, and sequentially writing the read waveform data into said first memory means at areas thereof from which previously stored waveform data have been read.

10. A method as claimed in claim 9, including a step of measuring an actual writing time period over which waveform data is actually written into said first memory means, and calculating said writing time period required for said unit data to be written into said first memory means, based on said actual writing time period and said memory capacity of said first memory means.

11. A method as claimed in claim 9, wherein when said waveform data to be transferred from said second memory means to said first memory means for generation of musical tones is smaller in amount that said memory capacity of said first memory means, said second step writes said waveform data to be transferred from said second memory means to said first memory means for generation of musical tones into said first memory means at one time, without dividing said waveform data to be transferred from said second memory means to said first memory means for generation of musical tones into said packets determined by said first step.

12. A method as claimed in claim 11, wherein when said writing time period required for said unit data to be written into said first memory means is shorter than said reading time period required for said unit data to be read from said first memory means, said second step divides said waveform data to be transferred from said second memory means to said first memory means for generation of musical tones into said packets determined by said first step, and when said writing time period required for said unit data to be written into said first memory means is longer than said reading time period required for said unit data to be read from said first memory means, said second step divides said waveform data to be transferred from said second memory means to said first memory means for generation of musical tones into said packets if a required total reproduction time period of said first memory means is shorter than a reproduction time period required for reproducing said waveform data to be transferred from said second memory means to said first memory means for generation of musical tones.

* * * * *